US009545141B2

(12) United States Patent
Hsieh

(10) Patent No.: US 9,545,141 B2
(45) Date of Patent: Jan. 17, 2017

(54) RECEIVING FOLDER WITH SELF-ARRANGEMENT

(71) Applicant: Yueh-Yin Hsieh, Taipei (TW)

(72) Inventor: Yueh-Yin Hsieh, Taipei (TW)

( * ) Notice: Subject to any disclaimer, the term of this patent is extended or adjusted under 35 U.S.C. 154(b) by 0 days.

(21) Appl. No.: 14/696,480

(22) Filed: Apr. 26, 2015

(65) Prior Publication Data

US 2016/0255932 A1 Sep. 8, 2016

(30) Foreign Application Priority Data

Mar. 6, 2015 (TW) ..... 104107294 A

(51) Int. Cl.
*A45C 1/06* (2006.01)
*A45C 13/18* (2006.01)
*A45C 13/02* (2006.01)

(52) U.S. Cl.
CPC ..... *A45C 13/185* (2013.01); *A45C 1/06* (2013.01); *A45C 13/02* (2013.01); *A45C 2001/067* (2013.01)

(58) Field of Classification Search
CPC . A45C 1/06; A45C 2001/065; A45C 2001/67; B65D 21/0234
USPC ..... 220/4.24, 4.21, 812, 815, 811; 150/147, 150/149; 206/477, 37, 425
See application file for complete search history.

(56) References Cited

U.S. PATENT DOCUMENTS 2,446,366 A * 8/1948 Epps ..... B65D 5/5253 206/278
3,136,398 A * 6/1964 Platt ..... A63B 47/007 206/315.9
3,937,389 A * 2/1976 Wind ..... B65D 1/34 206/557
4,776,462 A * 10/1988 Kosugi ..... G03F 1/66 206/449
6,871,682 B2 * 3/2005 Hogganvik ..... A45C 11/182 150/147
2012/0228168 A1 * 9/2012 Kitchen ..... A45C 11/182 206/307

* cited by examiner

*Primary Examiner* — King M Chu
(74) *Attorney, Agent, or Firm* — Chih Feng Yeh; Huntington IP Consulting Co., Ltd.

(57) ABSTRACT

The present invention provides a receiving folder with self-arrangement comprising a top cover and a bottom case. A capacity space is positioned between the top cover and the bottom case. A pair of first sidewalls of the top cover have first inclined edges, clamping units are formed on the first sidewalls. A pair of second sidewalls of the bottom case have second inclined edges. Inner of the bottom case has an elastic unit which end part extending upward to contact inner of the top cover. The back end of the bottom case has at least one plate. Wherein the first inclined edges are opposite to the second inclined edges, thus the first sidewalls are engaged with the second sidewalls.

17 Claims, 14 Drawing Sheets

RECEIVING FOLDER WITH SELF-ARRANGEMENT

CROSS-REFERENCE TO RELATED APPLICATION

This application claims the benefit of TAIWAN patent application serial number 104107294, filed Mar. 6, 2015.

TECHNICAL FIELD

This present application generally relates to a receiving folder, and more particularly, to a receiving folder with self-arrangement.

BACKGROUND OF RELATED ART

In today's commerce environment, with a variety of cards, everyone has at least one wallet which is regarded to fashion accessories. There are many kinds of wallets in the market, with folders in ladder type arrangement, to conform requirement of consumers, such as credit cards, driving license, ID, visa cards, and so on. However, prior wallets can solve problem of cards, but prior wallets have more folders resulting in increasing volume entirely, thereby causing inconvenience.

On the other hand, a variety of card holders may store business cards or other cards only, not mentioned to banknotes, coins and receipts. Additionally, users must search desired cards by thumbing through entire card holders themselves.

RFID refers to Radio Frequency IDentification. It typically applies to a technology that uses radio waves to automatically identify people or objects. RFID system is well knows in many field, such as purchasing objects, taking bus and library. RFID cards have substituted for magnetic stripe cards, gradually, to reduce trading time and improve convenience. However, hacker may hack privacy of RFID cards through simple improper wireless identifiers, because RFID cards is contactless. In prior art, most of wallets and card holders are made of soft materials which cannot resist radio wave of improper wireless identifiers, therefore, the data of RFID cards may be hacked.

In prior art, increasing number of folders to conform requirements of the consumers will increase the volume of the entire wallet, due to one folder only stores one card. Furthermore, prior wallet is lack of novelty, theft proof and water-resistant effect.

In order to solve the problem of the conventional arts, there is a need and focus in the related industry to provide a receiving folder, with self-arrangement, theft proof and water resistant, not only for arranging a plurality of cards, but also for storing other objects, such as coins, keys, memory cards, and so on.

SUMMARY

An object of the present invention is to provide a receiving folder with self-arrangement, more particularly, to provide a lightweight wallet, carrying conveniently, for storing cards, banknotes, coins, keys, and so on. The receiving folder is opened by a sliding gesture and self-arranges cards in a series arrangement, like pokes, so as to find the desired cards out quickly.

Another object of the present invention is to provide a receiving folder with self-arrangement including a top cover and a bottom case. There is a capacity positioned between the top cover and the bottom case. A pair of first sidewalls of the top cover have first inclined edges A pair of clamping units are formed on the first sidewalls. A pair of second sidewalls of the bottom case have second inclined edges, inner of the bottom case has an elastic unit and the end part of the elastic unit extends upward to contact the inner of the top cover, the end of the bottom case has at least one plate. Wherein the first inclined edges are opposite to the second inclined edges resulting in coupling with each other together.

According to one embodiment of the present invention, the front end of the inner top cover includes a first convex rib, and back end of the inner top cover includes a bump. The front end of the bottom case includes an extension part to couple with an opening of the front end of the top cover. The central top of the extension part includes a resisting part which inner top being bent toward the capacity space. The first sidewall includes a slide rail, the second sidewall includes a chute. The front end and back end of the outer first sidewall includes a first guiding unit and a first stopping unit, respectively. The back end and the front end of inner second sidewall includes a second guiding unit and a second stopping unit, respectively. The plate may be an elastic plate.

A further object of the present invention is to provide a self-arrangement and theft proof storage folder includes a top cover and a bottom case. There is a capacity positioned between the top cover and the bottom case. A pair of first sidewalls of the top cover have first inclined edges. A pair of clamping units are formed on the first sidewalls. A pair of second sidewalls of the bottom case have second inclined edges. The inner of the bottom case has an elastic unit and the end part of the elastic unit extends upward to contact the inner of the top cover, the end of the bottom case has at least one plate. The bottom case further includes an electromagnetic wave shielding layer. Wherein the first inclined edge is opposite to the second inclined edge, thus the first sidewall is engaged with the second sidewall.

According to one embodiment of the present invention, the front end of the inner top cover includes a first convex rib, and the back end of the inner top cover includes a bump. The front end of the bottom case includes an extension part to couple with an opening of the front end of the top cover. The central top of the extension part includes a resisting part and the inner top of the resisting part bents toward the capacity space. The first sidewalls include slide rails, the second sidewalls include chutes. The front end and the back end of outer first sidewalls include a first guiding unit and a first stopping unit, respectively. The back end and the front end of the inner second sidewalls include a second guiding unit and a second stopping unit, respectively. The plate may be an elastic plate.

BRIEF DESCRIPTION OF THE DRAWINGS

The components, characteristics and advantages of the present invention may be understood by the detailed description of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims. The layout of components may be more complicated in practice.

Figure 1:
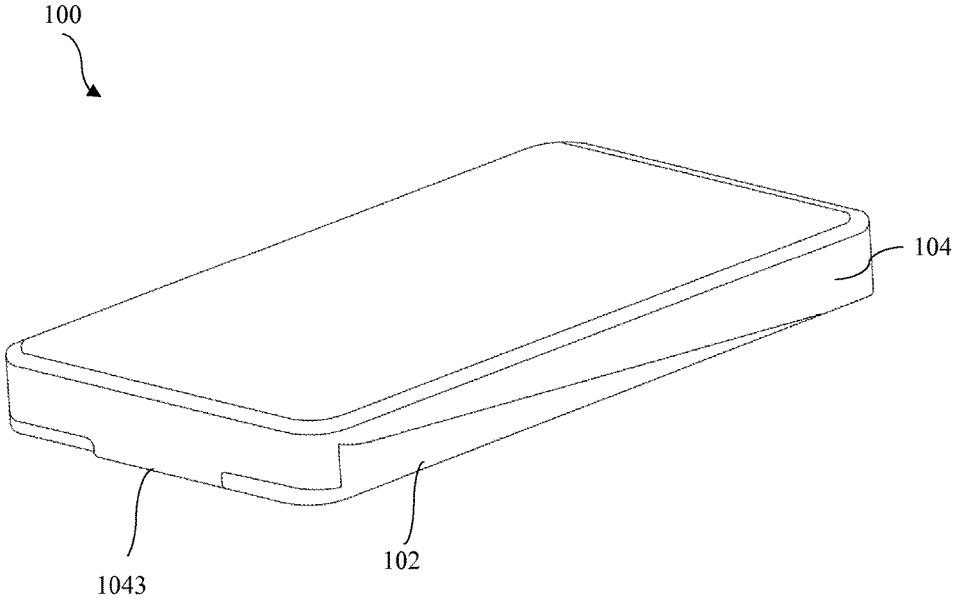
FIG. 1 illustrates a diagram of a receiving folder with self-arrangement according to the embodiment of the present invention.
Figure 7:
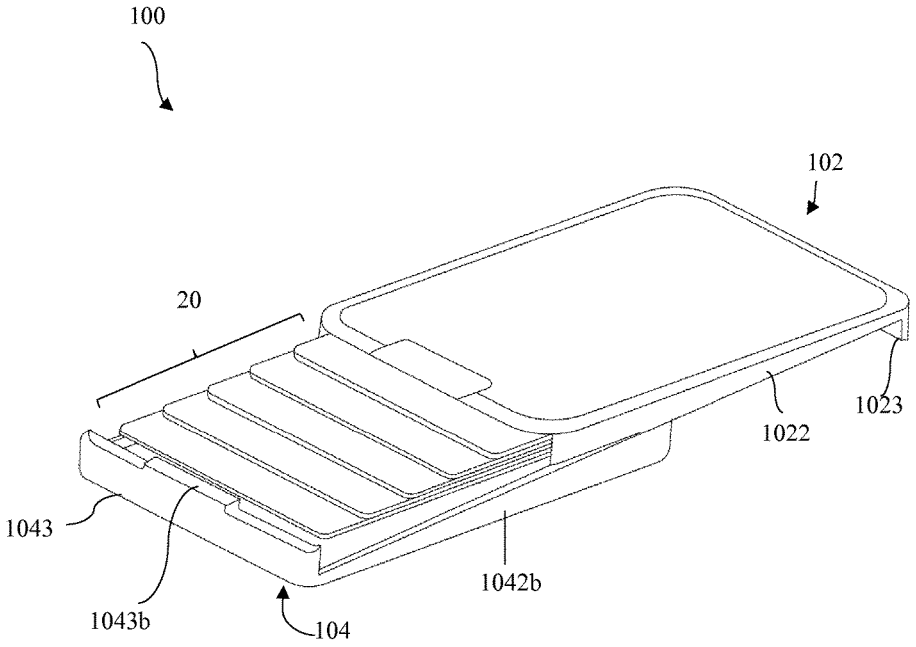
FIG. 7 illustrates a view of arrangement of cards stored in receiving folder according to the embodiment of the present invention.

FIG. 1 shows a diagram of the present invention. The present invention relates a sealing receiving folder (called the apparatus hereinafter) 100 formed by a top cover 102 and a bottom case 104, integrally. A capacity space 103 is positioned between the top cover 102 and the bottom case 104, for accommodating (or storing) objects including but not limited to coins, cards, banknotes, paper clips, keys and so on. The size of objects is based on the volume of capacity space 103. In an embodiment, the length, the width and the thickness of the apparatus 100 are, for example, 100 mm, 65 mm and 10 mm, respectively. In the preferred embodiment, the apparatus 100 can store cards, coins and keys. When the users slide the top cover 102 lightly, the apparatus 100 can spread out cards 20 in sequent, as shown in FIG. 7, due to simple and geometric units inside, to allow the users take out desired cards 20 easily and quickly.

Figure 2:
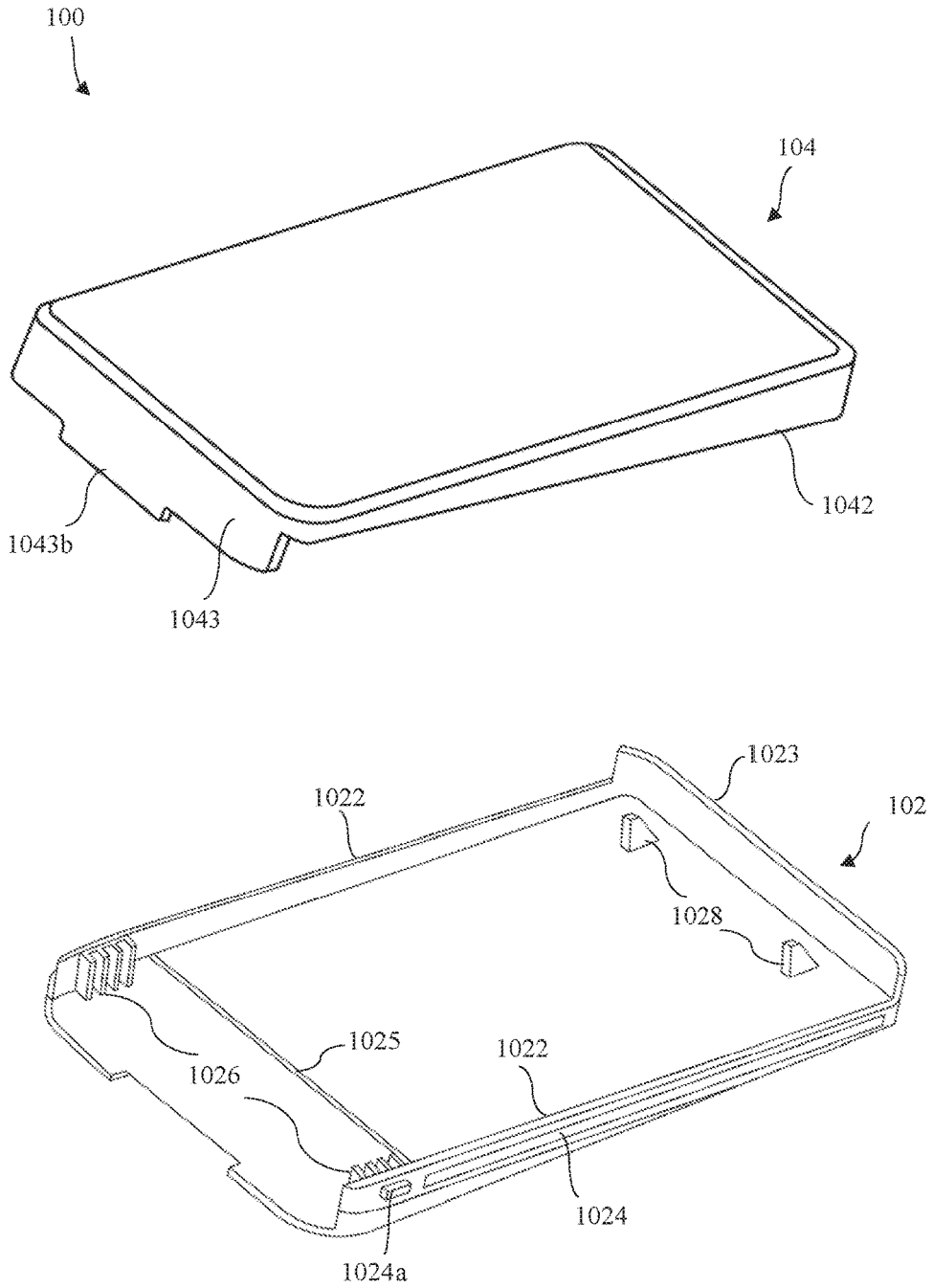
FIG. 2 illustrates an exploded view of a receiving folder with self-arrangement according to the embodiment of the present invention.
Figure 3:
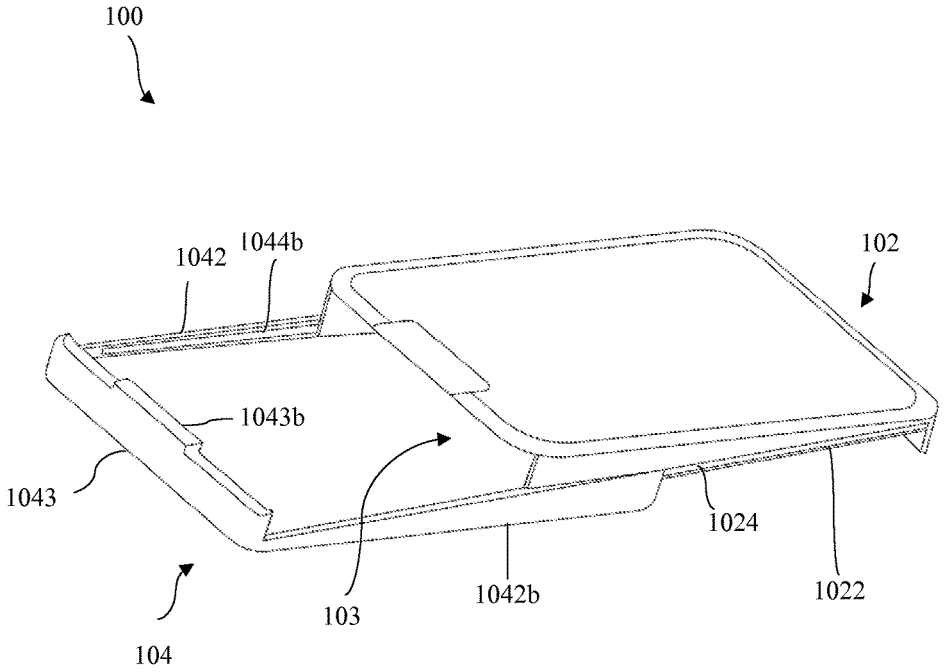
FIG. 3 illustrates a combination view of a receiving folder with self-arrangement according to the embodiment of the present invention.

Referring to FIG. 2 and FIG. 3, they show an exploded view and combination view, respectively, of the present invention. The top cover 102 and the bottom case 104 are coupled or connected with each other to form a sealing receiving folder. The top cover 102 and the bottom case 104 are made of plastic material. The right side and the left side of the top cover 102 have first sidewalls 1022, and the right side and the left side of the bottom case 104 have second sidewalls 1042, wherein the inclined direction of the first sidewalls 1022 are opposite to that of the sidewalls 1042. In the preferred embodiment, the first sidewalls 1022 may be wide at head portion and narrow at end portion, and the second sidewalls 1042 may be narrow at head portion and wide at end portion. The opposite inclined direction between the two sidewalls results in the top cover 102 and the bottom case 104 being coupled with each other together.

Figure 4A:
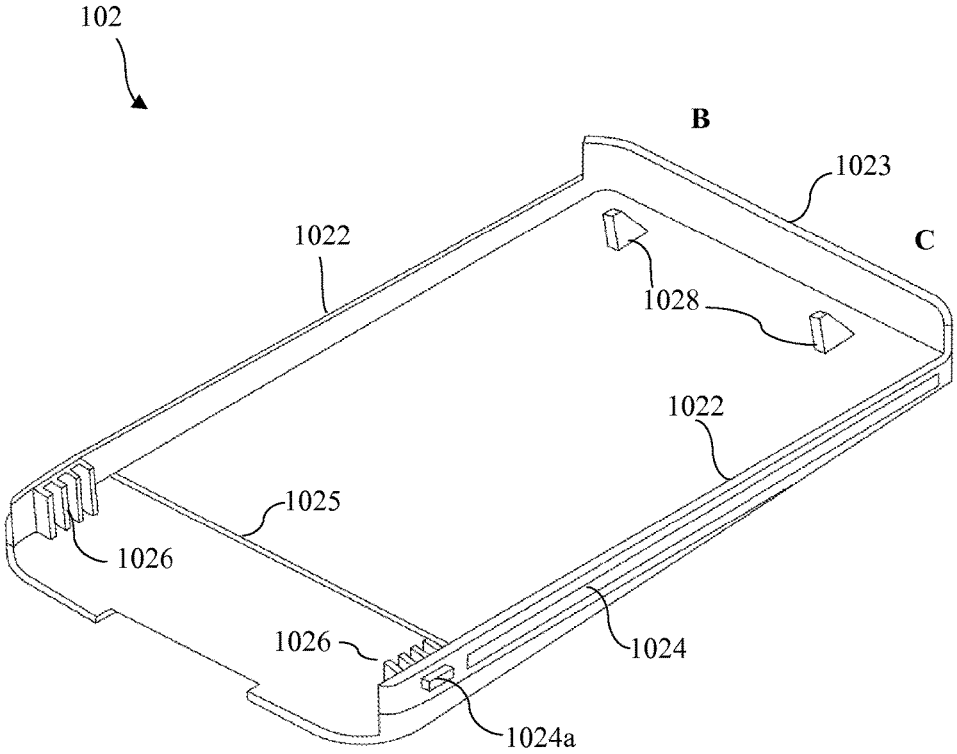
FIG. 4A illustrates a diagram of top cover according to the embodiment of the present invention.
Figure 4B:
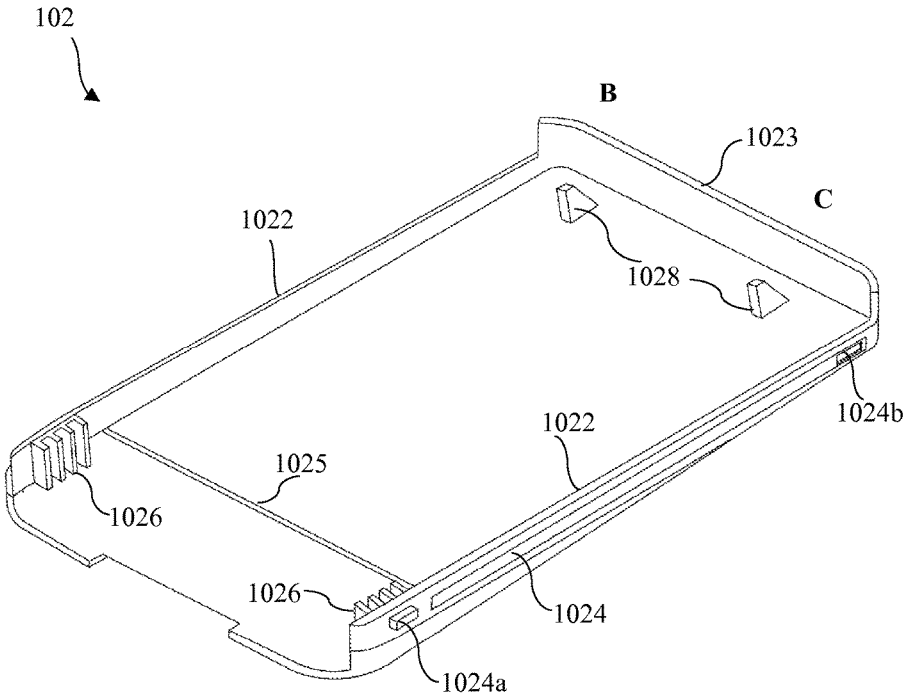
FIG. 4B illustrates a diagram of top cover according to the embodiment of the present invention.
Figure 4C:
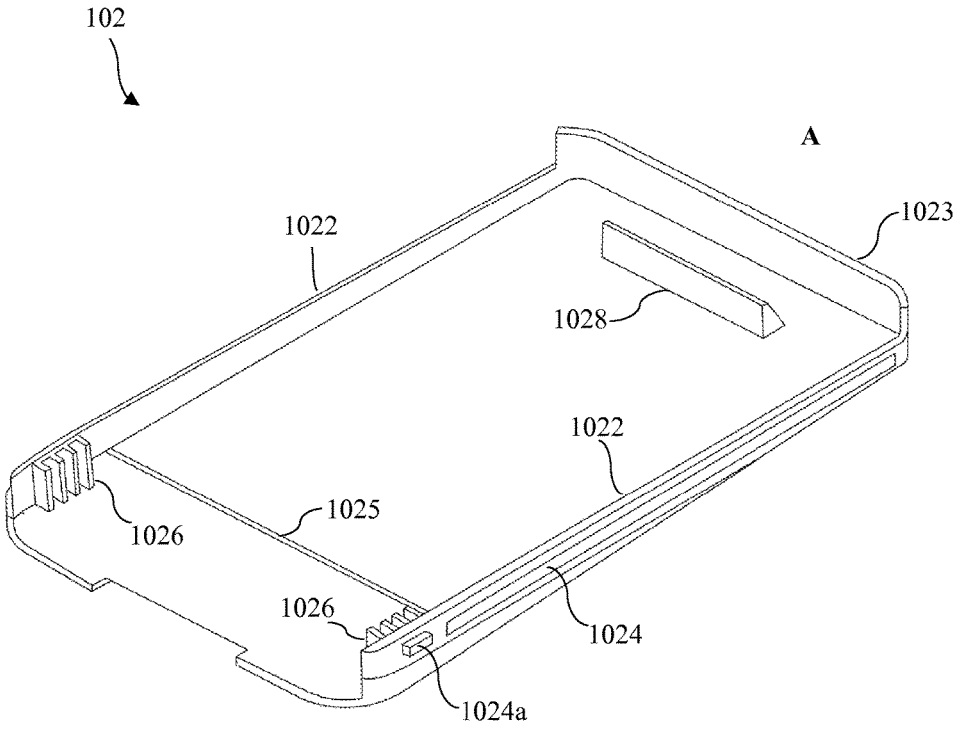
FIG. 4C illustrates a diagram of top cover according to the embodiment of the present invention.
Figure 5A:
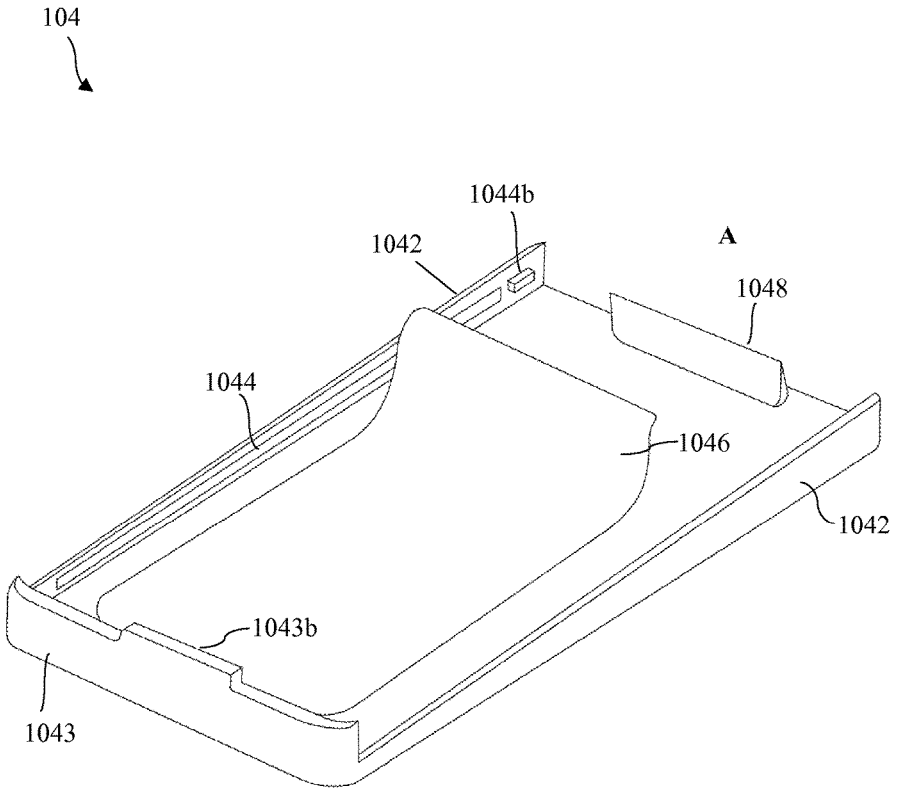
FIG. 5A illustrates a diagram of bottom case according to the embodiment of the present invention.
Figure 5B:
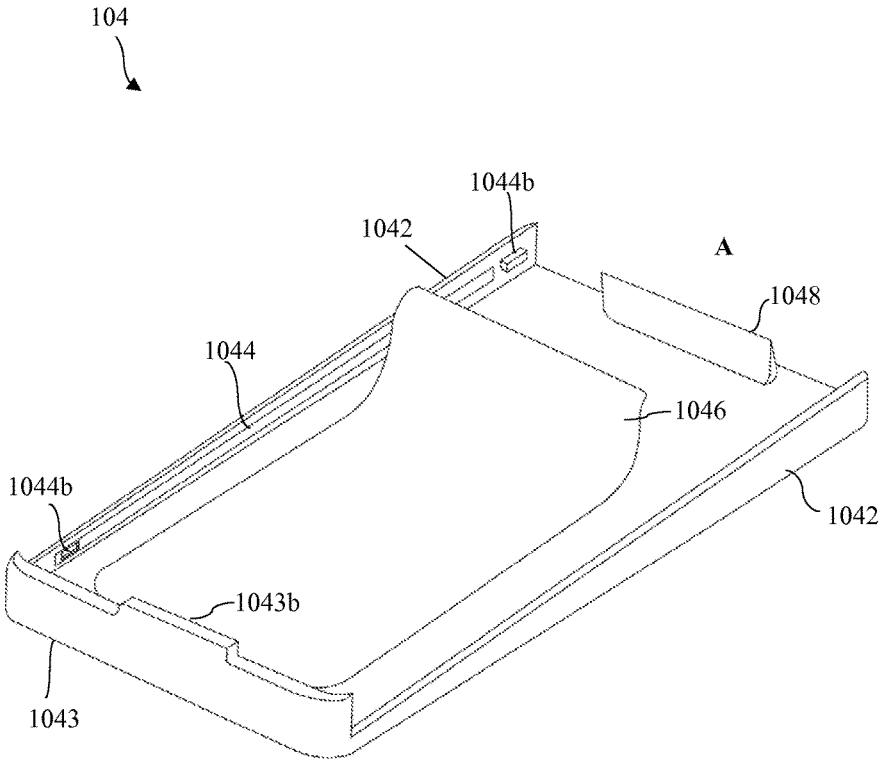
FIG. 5B illustrates a diagram of bottom case according to the embodiment of the present invention.
Figure 5C:
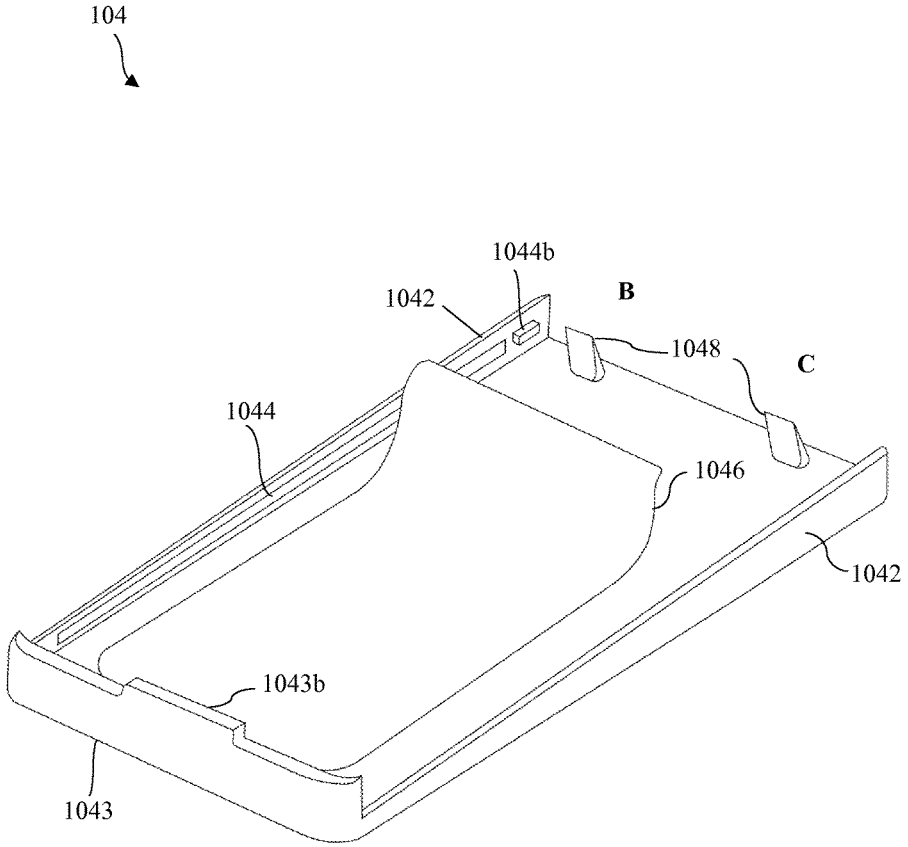
FIG. 5C illustrates a diagram of bottom case according to the embodiment of the present invention.

Referring to FIGS. 4A-4C, the outer first sidewalls 1022 of the top cover 102 have slide rails 1024, respectively. Referring to FIGS. 5A-5C, the inner second sidewalls 1044 of the bottom case 104 have chutes, respectively, to allow slide rails 1024 to locate and slide. Accordingly, the design of slide rails 1024 and chutes 1044 may promote match of the top cover 102 and bottom case 104 to achieve the purpose of easy installation and detachment. The matching method of the top cover 102 and the bottom case 104 includes but not limited to the design of slide rail and chute as the foregoing embodiment, it can be modified and varied by the skilled person in the art depending on the desire and expectation of the users. In the other embodiment, the outer first sidewalls 1022 of the top cover 102 have chutes. The inner second sidewalls 1042 of the bottom case 104 have slide rails. The alternative design for achieving the same effect as the foregoing embodiment can be modified or varied by the person skilled in the art in the light of the need in use, thereby not being further illustrated hereinafter.

In the preferred embodiment, referring to FIGS. 4A and 5A, the front end of the outer first sidewalls 1022 have first guiding units 1024*a* and the back end of the first guiding units have slide rails 1024. The back end of the inner second sidewalls 1042 have second guiding units 1044*b* which front end having chutes 1044. If the users want the first sidewalls 1022 to connect to the second sidewalls 1042, the first of all, the first guiding 1024*a* must be located a back end of the chute 1044, and the second guiding 1044*b* also must be located at the front end of the slide rail 1024. Then, pushing the top cover 1024 or/and the bottom case 104, the first guiding unit 1024*a* and the second guiding unit 1044*b* can slide along the chute 1044 and the slide rail 1024, respectively. When the first guiding unit 1024*a* slides to the front end of the chute 1044 and the second guiding unit 1044*b* slides to the back end of the slide rail 1024, the top cover 102 and the bottom case 104 are connected with each other to form a sealing receiving folder, as shown in FIG. 1. If the users would like to separate the top cover 102 from the bottom case 104, the direction of force and movement of separation are opposite to those of combination. It is well understood by the skilled person in the art, therefore, the redundancy illustration is omitted hereinafter.

In the preferred embodiment as above described, referring to FIG. 4B and 5B, the back end of the slide rail 1024 further includes a first stopping unit 1024*b*, and the front end of the chute 1044 further includes a second stopping unit 1044*a*. When the top cover 102 reaches predetermined location, the first guiding unit 1024*a* of the front end of the top cover 102 may couple to the second stopping unit 1044*a* of the front end of the bottom case 104. Apparently, the first stopping unit 1024*b* of the back end of the top cover 102 may connect to the second guiding unit 1044*b* of the back end of the bottom case 104. Guiding units 1024*a* and 1044*b* are convex and stopping units 1024*b* and 1044*a* are slots. It is well understood that the size of convex is corresponding to that of slot by the skilled person in the art, so as to fasten the top cover 102 and the bottom case 104 together to avoid loosening, furthermore, the sealing apparatus 100 may have water-resistant effect. In other embodiment, the front end and the back end of slide rail 1024 has a first stopping unit and a second guiding unit, respectively. The front end and the back end of the chute 1044 have a second guiding unit and a second stopping unit, respectively. The alternative design of stopping units and guiding units for achieving the same effects as the foregoing embodiment can be modified or varied by a person skilled in the art according to the need in use.

Referring to FIG. 4A-4C, the front end of the two sidewalls of the top cover 102 has a clamping unit 1026, respectively, for fastening the cards 20 in the capacity space 103. In the preferred embodiment, the material of clamping unit 1026 includes but not limited to elastic and plastic material which would fasten various size cards 20. In the embodiment, clamping unit 1026 includes but not limited to fin, bump, protruding or interdigitated structure. In the preferred embodiment, the clamping unit 1026 is fin structure, as shown in FIGS. 4A-4C. The skilled person in the art well understand that the location of clamping 1026 includes but not limited to the front end of the inner sidewall, it may be other location depending on the required conditions, such as middle of inner sidewall or the back end of the inner sidewall. In one embodiment, the back end of inner top cover 102 has a bump 1028 for resisting cards 20.

Figure 6A:
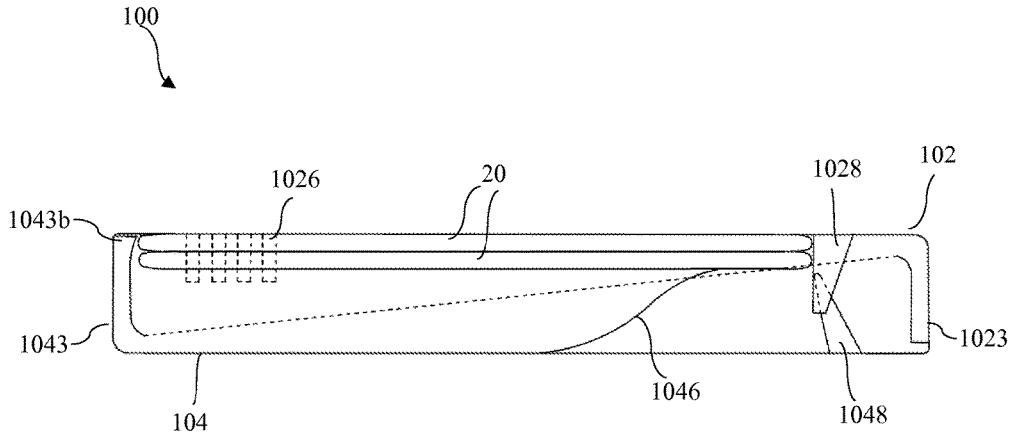
FIG. 6A illustrates a sectional view of closing receiving folder according to the embodiment of the present invention.
Figure 6B:
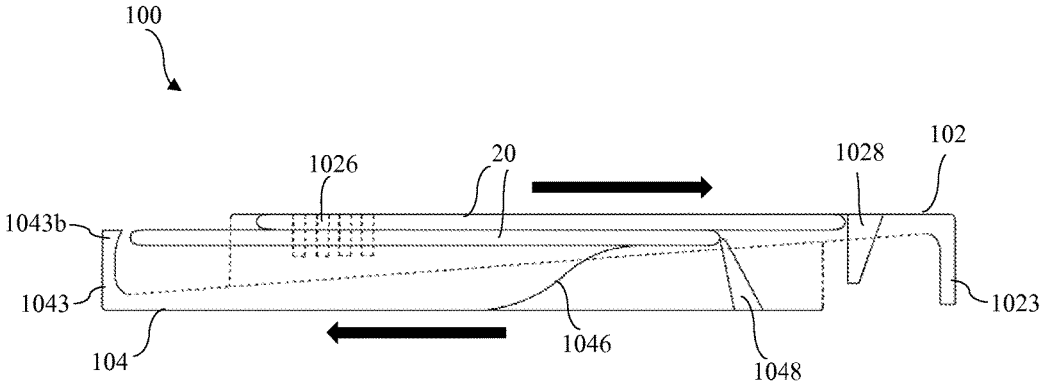
FIG. 6B illustrates a sectional view of opening receiving folder according to the embodiment of the present invention.

The inner bottom case 104 has elastic unit 1046, that includes but not limited to spring or elastic plate. In the preferred embodiment, referring the FIG. 5A-5C, elastic unit 1046 is a metal plate which front end (about ⅔) attached onto the inner bottom case 104 and the back end (about ⅓) extended upward to contact inner top cover 102, for blocking the cards 20. It should be noted that the extending part of the elastic unit 1046 is not limited to back end as above described, but also may include front end or middle of the elastic unit 1046. The cards 20 are against by clamping units 1026 of two sides and elastic units 1046 of the top cover 102, so that the cards 20 will not be drop off from the top cover 102. Referring to FIGS. 6A-6B, they show sectional views for closing and opening of receiving folder, respectively. The back end of the bottom case 104 has at least one plate 1048. When the top cover 102 with cards 20 is slid downward, as shown left arrow in FIG. 6B, the plate 1048 of the bottom case 104 can resist the cards 20 to prevent it from moving along the top cover 102. Furthermore, the apparatus 100 can spread out the cards 20 in series, like pokes as shown in FIG. 7, by the combination of the two sidewalls with the opposite inclined edges and the plate 1048. In one embodiment, the plate 1048 is positioned onto the bottom case 104 vertically. In the preferred embodiment, the plate 1048 may be elastic and is positioned onto the bottom case 104, alternatively, is received parallel with the bottom case 104.

Referring to FIGS. 4A and 5A, in the preferred embodiment, when the bump 1028 is located on B and C, then the plate 1048 must be located on A. Referring to FIGS. 4C and 5C, in other embodiment, when the bump 1028 is located on A, then the plate 1048 must be located on B and C. As description above, "A" means center of back end, "B" and "C" means two sides nearby back end. It is well understood that location of bump and plate should be staggered each other to avoid conflicting by the skilled person in the art.

The front end of the bottom case 104 has a first extension part 1043 which extending upwards to couple with the front opening of the top cover 102. Apparently, the back end of the top cover 102 has a second extension part 1023 which extending downward to couple with back opening of the bottom case 104. Accordantly, the top cover 102 and the bottom case 104 can be coupled with each other to form a sealing receiving folder, furthermore, it may have the water-resistant capability. In one embodiment, the top inner of the resisting part 1043*b*, positioned on the center top of the first extension part 1043, is bent forward the capacity space 103, as shown in FIGS. 6A, 6B, 8A, 8B, 9, 10. The resisting part 1043 can resist cards 20 to avoid exceeding beyond the bottom case 104 when the top cover 102 sliding upward for storing cards 20.

Figure 8A:
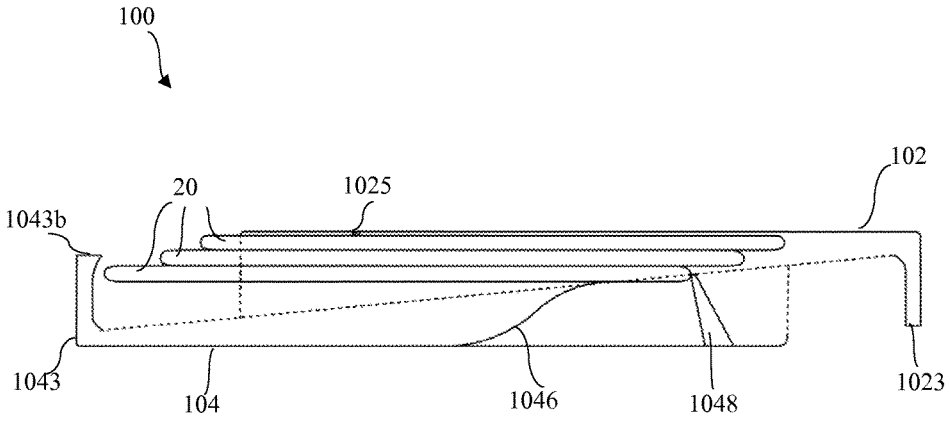
FIG. 8A illustrates a sectional view of opening receiving folder according to the embodiment of the present invention.
Figure 8B:
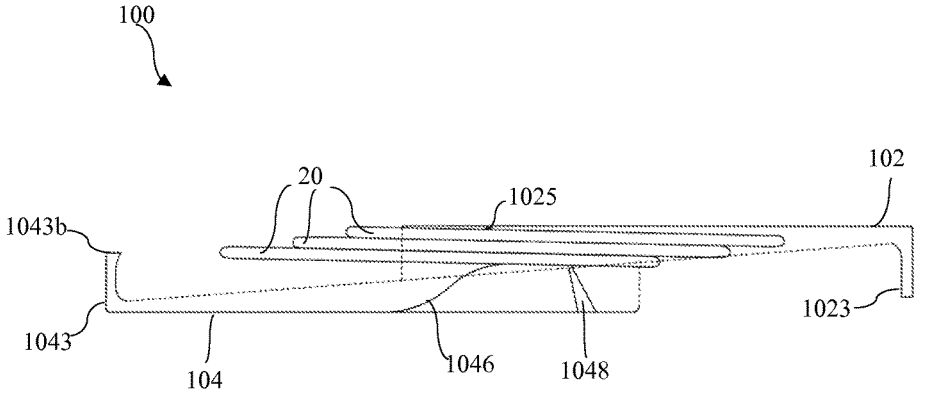
FIG. 8B illustrates a sectional view of closing receiving folder according to the embodiment of the present invention.

In one embodiment, referring to FIGS.8A-8B, the front end of the top cover 102 has a convex rib 1025 for storing and spreading out the cards 20. The relative location between the convex rib 1025 and the elastic unit 1046 is based on the relative location between the top cover 102 and the bottom case 104. When the front end of the top cover 102 is separated from the front end of the bottom case 104, the plate 1048 can promote spread out the cards 20 in a sequence arrangement. When the first guiding unit and the second guiding unit are conflicted with each other (that is opening totally), as shown in FIG. 8B, the back end of cards 20 rise upward slightly, approximately higher than the first extension part 1043, resulted from the plate 1048 is against on the middle of a side of the cards 20 and the convex rib 1025 is against on the front end of another side of the cards 20, so as to take out any cards randomly. When the top cover 102 and the bottom case 104 are closing gradually, the force point of elastic unit 1046 moves to the back end of cards 20 and convex rib 1025 is against on the front end of cards 20, as shown in FIG. 8A, the cards 20 would reposition to the same high same with the first extension part 1043, thereby improving the convenience of storing. In other words, the horizontal angle of the cards 20 could be adjusted by the relative applying force points between the convex rib 1025 and the elastic unit 1048. The cards 20 are not only found out easily, but also received smoothly. It is noted that omitting some elements in FIGS. 8A-8B, such as the resisting part 1028 and the clamping unit 1026, makes readers more understand main aspects of those drawings.

In order to prevent the information from being hacked, the present also provides a receiving folder with theft proof (called the apparatus 200 hereinafter). The apparatus 200 is similar with the apparatus 100. The apparatus 200 is formed by a top cover 202 and a bottom case 204 to form a sealing receiving folder. The left side and the right side of the top cover 202 are first sidewalls 2022 which outer have slide rails 2024. The left side and the the right side of the bottom case 204 are second sidewalls 2042 which inner have chutes 2044. The top cover 202 and the bottom case 204 are coupled with each other by slide rail and chute, like the apparatus 100. Apparently, other elements of the top cover 202 and the bottom case 204 are similar with those of apparatus 100, as shown in FIGS. 1-8.

Figure 9:
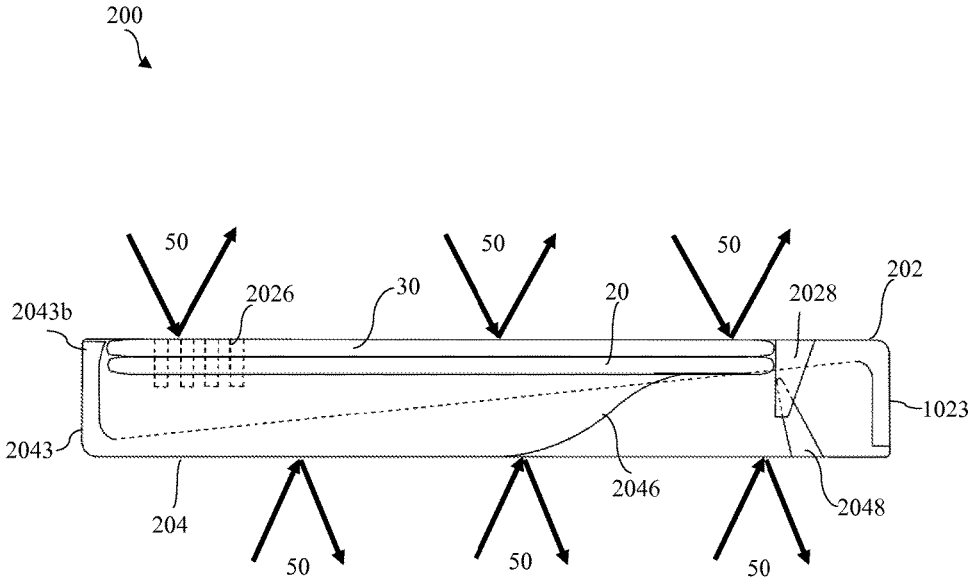
FIG. 9 illustrates a sectional view of closing receiving folder according to the second embodiment of the present invention.

Referring to FIG. 9, in an embodiment, the elastic unit 2046 of inner bottom case 204 may reflect the radio wave 50 of improper wireless identifiers to prevent data of RFID cards from stealing, resulted from the elastic unit 2046 is made of metal material that could have shielding effect. In one embodiment, the elastic unit 2046 includes but not limited to tin or stainless steel. In the preferred embodiment, the bottom case 204 includes an electromagnetic shielding layer (not shown in drawings) which can shield against the radio wave 50. In more detail, the electromagnetic shielding layer may coated between the elastic unit 2046 and the bottom case 204, or, coated onto the outside surface, but not limited to that. It is well understood that the material of electromagnetic shielding layer includes but not limited to conducting material or ferromagnetic material. In the preferred embodiment as above described, the top cover 202 has a metal card 30 which fastened between the clamping unit 2026 of the two sides of the top cover 202. The thickness of the metal card 30 is enough to shield against the radio wave 50 of improper wireless identifiers. The material of metal card 30 includes but not limited to tin or stainless steel. Both of the top surface and the bottom surfaces of the apparatus 200 have theft proof, more particularly, can prevent RFID card from stealing.

Figure 10:
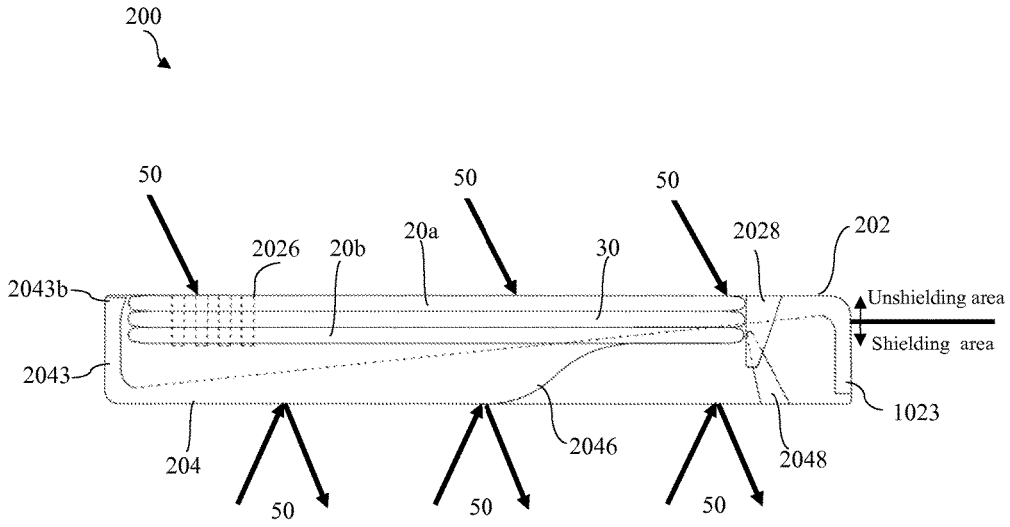
FIG. 10 illustrates a sectional view of closing receiving folder according to the second embodiment of the present invention.

Referring to FIG. 10, in the preferred embodiment, the apparatus 200 inside has selective shielding. An electromagnetic wave absorbing material can be coated onto the top surface, which contacting with the top cover 202, of the metal card 30 for absorbing the radio wave 50 from identifiers. Electromagnetic wave absorbing material includes but not limited to composite materials, such as soft magnetic material, conducting fiber, magnetic powder with carbonyl group. It is well understood that the species and contents of electromagnetic wave absorbing material can be modified or varied based on required conditions by a person skilled in the art. For example, first card 20*a*, such as EasyCard, is located upon the metal card 30. The second card 20*b*, such as credit card, is located below the metal card 30. Because the top and bottom sides of the second card 20*b* are covered by metal materials, electromagnetic shielding layer (or elastic unit 2046) and the metal card 30, the apparatus 200 can shield against the radio wave 500 of peripheral devices, so that the second card 20*b* cannot be read and hacked. On the other hand, the first card 20*a* can be read by wireless identifiers due to the first card 20*a* be located upon electromagnetic wave absorbing material. Accordantly, the first card 20*a*, without taking out from the apparatus 200, can be read by wireless identifiers through the top cover 202, thereby improving convenience and security.

As description above, the present invention provides a receiving folder with self-arrangement and water-resistance. The present invention only has one folder to accommodate cards or other lightweight objects. The present invention can spread out cards in sequence arrangement by sliding the top cover or the bottom case resulted from the sidewalls, the clamping units, the elastic units, the plate and a combination of them, for users can take cards out easily. On the other hand, the present invention also provides a receiving folder with self-arrangement and theft proof resulted from the metal card fastened by the top cover and the elastic units of the bottom case could resist radio wave from improper identifiers, so that prevents RFID cards from being hacked. Furthermore, the present invention solves prior wallet having many folders inside, and provides a sealing receiving folder to achieve water-resistant effect. Especially, the present invention provides a receiving folder with self-arrangement by particular design. On the other hand, the present invention has theft proof resulted from metal elements inside to resist radio wave of improper wireless identifiers.

In this context, cards includes but not limited to credit card, visa card, National Health Insurance Card, business card, and so on. In the specification, "front side" or "front end" is corresponding to "back side" or "back end", as shown in FIGS. 1-9, "front" and "back" can refer to the right side and left side of drawings, respectively. If the specification refers to "inner", it means a surface contacting the capacity space, on the contrary, "outer" is opposite to "inner".

Various terms used in this disclosure should be construed broadly. For example, if an element "A" is said to be coupled to or with element "B," element A may be directly coupled to element B or be indirectly coupled through, for example, element C. When the specification states that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification refers to "a" or "an" element, this does not mean there is only one of the described elements.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

What is claimed is:

1. A receiving folder comprising:

a top cover and a bottom case to form a capacity space positioned between said top cover and said bottom case, wherein a pair of first sidewalls of said top cover having first inclined edges, a pair of clamping units being formed on said pair of first sidewalls;

a pair of second sidewalls of said bottom case having second inclined edges, said bottom case has an elastic unit therein, wherein an end of said elastic unit extends upward to contact an inner of said top cover, an end of said bottom case has at least one plate; and wherein said pair of first sidewalls having first sliding elements, said pair of second sidewalls having second sliding elements, said first inclined edges are opposite to said second inclined edges, thereby said pair of first sidewalls and said pair of second sidewalls are engaged with each other by coupling of said first sliding elements and said second sliding elements.

2. The receiving folder of claim 1, wherein said inner of said top cover having a first convex rib, said inner of said top cover having a bump.

3. The receiving folder of claim 1, wherein said bottom case having an extension part to connect with an opening of said top cover.

4. The receiving folder of claim 3, wherein a central top of said extension part having a resisting part, inner top of said resisting part is bent toward said capacity space.

5. The receiving folder of claim 1, wherein said pair of first sidewalls having slide rails, said pair of second sidewalls having chutes.

6. The receiving folder of claim 1, wherein said pair of first sidewalls comprising first guiding units, a back end of said first guiding units having slide rails, said pair of second sidewalls comprising second guiding units, a front end of said second guiding units having chutes.

7. The receiving folder of claim 6, wherein a back end of said slide rail having a first stopping unit, a front end of said of chute having a second stopping unit.

8. The receiving folder of claim 7, wherein said first guiding unit and said second guiding unit are convex, said first stopping unit and said second guiding unit are slots.

9. A receiving folder comprising:

a top cover and a bottom case to form a capacity space positioned between said top cover and said bottom case, wherein a pair of first sidewalls having first inclined edges, a pair of clamping units being formed on said pair of first sidewalls for fastening a metal card;

a pair of second sidewalls of said bottom case having second inclined edges, said bottom case has an elastic unit therein, wherein an end of said elastic unit extends upward to contact an inner of said top cover, said bottom case has at least one plate, said bottom case further comprising an electromagnetic shielding layer; and wherein said pair of first sidewalls having first sliding elements, said pair of second sidewalls having second sliding elements, said first inclined edges are opposite to said second inclined edges, thereby said pair of first sidewalls and said pair of second sidewalls are engaged with each other by coupling of said first sliding elements and said second sliding elements.

10. The receiving folder of claim 9, wherein said inner of said top cover having a first convex rib, said inner top cover having a bump.

11. The receiving folder of claim 9, wherein said bottom case having an extension part to connect with an opening of said top cover.

12. The receiving folder of claim 11, wherein a central top of said extension part having a resisting part, inner top of said resisting part is bent toward said capacity space.

13. The receiving folder of claim 9, wherein said pair of first sidewalls having slide rails, said pair of second sidewalls having chutes.

14. The receiving folder of claim 9, wherein said pair of first sidewalls comprising a first guiding unit, a back end of said first guiding unit having a slide rail, said inner pair of first sidewalls comprising a second guiding unit, a front end of said second guiding unit having a chute.

15. The receiving folder of claim 14, wherein a back end of said slide rail having a first stopping unit, a front end of said of chute having a second stopping unit.

16. The receiving folder of claim 15, wherein said first guiding unit and said second guiding unit are convex, said first stopping unit and said second guiding unit are slots.

17. The receiving folder of claim 9, wherein a top surface of said metal card comprising an electromagnetic wave absorbing material.

* * * * *